US007907855B2

(12) United States Patent
Akita

(10) Patent No.: US 7,907,855 B2
(45) Date of Patent: Mar. 15, 2011

(54) IMAGE FORMING APPARATUS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 392 days.

(21) Appl. No.: 12/030,390

(22) Filed: Feb. 13, 2008

(65) Prior Publication Data

US 2008/0193152 A1 Aug. 14, 2008

(30) Foreign Application Priority Data

Feb. 14, 2007 (JP) ..... 2007-033598

(51) Int. Cl.

| | |
|---|---|
| ***G03G 15/00*** | (2006.01) |
| ***G03G 15/06*** | (2006.01) |
| ***G03G 15/09*** | (2006.01) |
| ***G03G 15/08*** | (2006.01) |

(52) U.S. Cl. ..... 399/44; 399/55; 399/270; 399/285

(58) Field of Classification Search ..... 399/44, 399/54, 55, 223, 228, 270, 285; 430/127.7, 430/127.8

See application file for complete search history.

(56) References Cited

U.S. PATENT DOCUMENTS

| | | | | |
|---|---|---|---|---|
| 5,784,668 | A * | 7/1998 | Hyakutake et al. | 399/55 |
| 6,553,192 | B2 * | 4/2003 | Maebashi | 399/50 |
| 7,058,326 | B2 * | 6/2006 | Toyama | 399/50 |
| 7,266,315 | B2 * | 9/2007 | Sato | 399/38 |
| 2004/0136742 | A1 * | 7/2004 | Saito et al. | 399/55 |
| 2006/0251432 | A1 * | 11/2006 | Shibata | 399/44 |
| 2007/0020545 | A1 * | 1/2007 | Bossidan et al. | 430/108.21 |

FOREIGN PATENT DOCUMENTS

| | | | |
|---|---|---|---|
| JP | 9-230693 A | | 9/1997 |
| JP | 2001-188394 A | | 7/2001 |
| JP | 2002268322 A | * | 9/2002 |
| JP | 2003-255663 A | | 9/2003 |

* cited by examiner

*Primary Examiner* — David M Gray
*Assistant Examiner* — Francis Gray
(74) *Attorney, Agent, or Firm* — Fitzpatrick, Cella, Harper & Scinto

(57) ABSTRACT

An image forming apparatus including a first developing device including a first developer carrying member for carrying a developer containing toner, wherein a developing voltage including an AC component is applicable to the first developer carrying member to develop an electrostatic image; a second developing device including a second developer carrying member for carrying a developer containing toner, wherein a developing voltage including an AC component is applicable to the second developer carrying member to develop an electrostatic image; a transferring device for transferring a toner image formed by the first developing device to a moving transfer medium and then transferring a toner image formed by the second developing device onto the transfer medium; a controller for selectively executing an operation in a first mode wherein the image is formed by both of the first developing device and the second developing device or in a second mode wherein the image is formed by only the second developing device of the developing devices; wherein the second developing device is capable of developing operation with the developing voltage having the AC component which is smaller in amplitude in the first mode than in the second mode.

5 Claims, 8 Drawing Sheets

(a) DRUM (b) INTERMEDIARY BELT

IMAGE FORMING APPARATUS

FIELD OF THE INVENTION AND RELATED ART

The present invention relates to an image forming apparatus which transfers multiple toner images in layers onto a recording medium or intermediary transferring member. More specifically, it relates to a method for controlling a color image forming apparatus to minimize the unintended color mixture attributable to toner particles having reversed in polarity.

An electrophotographic (or electrostatic) image forming apparatus, that is, an image forming apparatus which forms an electrostatic image on its image bearing member, and develops the electrostatic image into a toner image with electrically charged toner, has been put to practical use. The developing apparatus of an electrophotographic image forming apparatus has a developer bearing member. It applies transfer voltage, that is, a combination of DC and AC voltages to the developer bearing member so that the toner in the developer on the developer bearing member jumps from the developer bearing member to the image bearing member, and adheres to the electrostatic image on the image bearing member.

A full-color image forming apparatus in which multiple image forming portions (each of which has an image bearing member) are positioned in tandem along the circular path of its intermediary transferring member, or recording medium conveying member, has been put to practical usage. There has also been put to practical use a full-color image forming apparatus, which has only a single image bearing member. In the case of the latter image forming apparatus, multiple toners images (different in color) are sequentially formed on the single image bearing member, and are sequentially transferred in layers onto recording medium borne on the recording medium conveying member, or intermediary transfer member. These full-color image forming apparatuses are enabled to operate in a black monochromatic mode as well as in a full-color mode so that they can be optimally operated under various operational conditions and/or image formation requirements. A full-color mode is the mode in which yellow, magenta, cyan, and black toner images are transferred, whereas a black monochromatic mode is the mode in which only black toner image is transferred.

Japanese Laid-open Patent Application H09-230693 discloses an image forming apparatus of the so-called reversal development type. In the case of an image forming apparatus of the reversal development type, the peripheral surface of its image bearing member is charged to the same polarity as the polarity to which toner is charged. Then, the charged peripheral surface of the image bearing member is exposed (scanned with beam of light) so that the exposed points of the peripheral surface of the image bearing member reduce in potential. Then, toner is adhered to the exposed points, that is, the points having reduced in potential. One of the objects of Japanese Laid-open Patent Application H09-230693 is to prevent the problem that reversely charged toner particles electrostatically adhere to the unexposed points of the peripheral surface of the image bearing member, which results in the formation of a foggy image. As one of the solutions to this problem, this patent application proposes the following method: The image forming apparatus is provided with a recovery roller, which is charged to a potential level higher than the potential level of the unexposed points, and is placed in contact with the area of the peripheral surface of the image bearing member, on which an electrostatic image is present, so that the reversely charged toner particles are electrostatically moved from the unexposed points onto the recovery roller.

Japanese Laid-open Patent Application 2003-255663 discloses another image forming apparatus designed to solve the above-described problem. This image forming apparatus employs a single photosensitive drum, four developing devices, that is, yellow, magenta, cyan, and black developing devices, and an intermediary transfer drum. The yellow, cyan, and magenta developing devices use two-component developer, and are mounted in a rotary, whereas the black developing device is stationary, and uses magnetic single-component developer. The rotary is positioned next to the photosensitive drum so that any of the three developing devices in the rotary can be rotated into the position at which they oppose the photosensitive drum. The black developing device is fixedly positioned next to the photosensitive drum. In the case of this image forming apparatus, yellow, magenta, cyan, and black toner images are sequentially formed on the same photosensitive by switching the developing device which is to be placed in the development position. The four toner images, different in color, are sequentially transferred in layers (primary transfer) onto the intermediary transfer drum of the image forming apparatus, and then, are transferred together (secondary transfer) onto a recording medium from the intermediary transfer drum.

Japanese Laid-open Patent Application 2001-188394 discloses an image forming apparatus which has yellow, magenta, cyan, and black image forming portions, which are arranged in tandem, next to the top portion (straight portion) of the loop which the recording medium conveying member forms. In terms of the recording medium conveyance direction, the four image forming portions are between the upstream and downstream ends of the loop. In the case of this image forming apparatus, while the recording medium is conveyed by its recording medium conveying belt, while remaining adhered to the belt, four monochromatic toner images, different in color, are directly transferred in layers onto the recording medium.

When any of the image forming apparatuses of the above-mentioned types is operated in the full-color mode, multiple monochromatic toner images, different in color, are formed. Thus, if the fog causing black toner particles having adhered to the image bearing member mix with the toner images of the other colors, a full-color image which is lower in brightness than an intended full-color image is yielded. For example, if the fog causing black toner particles mix with a yellow toner image, which is substantially higher in brightness than the black toner, the difference in brightness between a portion of the yellow toner image, into which the black residual toner mixed, and a portion of the yellow toner image, into which black residual toner did not mix, is visually conspicuous. Therefore, the fog causing black toner particles must be reduced as much as possible.

However, the recovery roller disclosed in Japanese Laid-open Patent Application H09-230693 recovers the reversely charged toner by being rotated in contact with the entirety of the peripheral surface of the photosensitive drum, in terms of the direction parallel to the axial line of the photosensitive drum. Therefore, it comes into contact with the entirety of the portion of the peripheral surface of the photosensitive drum, across which a latent image is developed. In other words, not only does it come into contact with the portions of the toner image, which correspond to the unexposed portions of the photosensitive drum, but also, the portions of the toner image, which correspond to the exposed portions of the photosensitive drum. Thus, it is possible that the recovery roller will have electrically and mechanically undesired effects upon the toner image.

In recent years, a photosensitive drum as an image bearing member has been reduced in diameter, as small as roughly 30 mm, and yet, a charging apparatus, an exposing apparatus, a developing apparatus, etc., have to be placed in the adjacencies of the peripheral surface of a photosensitive drum, making it difficult to place a recovery roller such as the aforementioned one, in the adjacencies of the peripheral surface of the photosensitive drum. Not only is it difficult to place a recovery roller next to the peripheral surface of the photosensitive drum, but also, it is even more difficult to place the motor and linkage for rotating a recovery motor in synchronism with the photosensitive drum, in the space next to the lengthwise ends of the axle of the photosensitive drum, since the space is already filled with various intricately positioned driving mechanisms.

It has been thought that it is in the developer reservoir of a developing device that the toner particles become reversely charged. However, in recent years, it has been confirmed that a substantial ratio of toner particles in the developer become reversely charged while the developer (toner) borne on a development sleeve is moved through the development area, as will be described later.

It has also been confirmed that this phenomenon that toner particles become reversely charged on the development sleeve is likely to occur when black toner which contains carbon is used in an environment which is high in humidity.

SUMMARY OF THE INVENTION

Thus, the primary object of the present invention is to provide an image forming apparatus which is significantly smaller in the amount by which it produces the fog causing toner particles, being therefore significantly smaller in the amount by which the fog causing black toner particles mix into monochromatic toner images of the other colors when the apparatus is in the full-color mode, than an image forming apparatus in accordance with the prior art.

According to an aspect of the present invention, there is provided an image forming apparatus comprising a first developing device including a first developer carrying member for carrying a developer containing toner, wherein a developing voltage including an AC component is applicable to said first developer carrying member to develop an electrostatic image; a second developing device including a second developer carrying member for carrying a developer containing toner, wherein a developing voltage including an AC component is applicable to said second developer carrying member to develop an electrostatic image; a transferring device for transferring a toner image formed by said first developing device to a moving transfer medium and then transferring a toner image formed by said second developing device onto the transfer medium; a controller for selectively executing an operation in a first mode wherein the image is formed by both of said first developing device and said second developing device or in a second mode wherein the image is formed by only said second developing device of said developing devices; wherein said second developing device is capable of developing operation with the developing voltage having the AC component which is smaller in amplitude in the first mode than in the second mode.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. As long as the application of the present invention concerns the reduction in the amount by which reversely charged toner particles adhere to an image bearing member, by reducing in amplitude the AC voltage used for development, the present invention is also applicable to various image forming apparatuses (developing device) which are partially or entirely different in structure from the image forming apparatuses in the following embodiments of the present invention.

Not only is the present invention applicable to an image forming apparatus in which multiple image forming apparatuses are arranged in tandem along the loop which the intermediary transfer member or recording medium conveying member of the apparatus forms, but also, an image forming apparatus having a single image bearing member, and multiple developing devices which are sequentially arranged in the adjacencies of the image bearing member, and which are different in the color in which they develop a latent image. Incidentally, the intermediary transfer member and recording medium are regarded as an object onto which a toner image is transferred from an image bearing member, and therefore, both may be referred to as a transfer medium hereafter.

The following embodiments of the present invention will be described with reference to only the portions of the image forming apparatus, which are essential to the formation of a toner image. However, the present invention is also applicable to various image forming apparatuses, such as a printer, a copying machine, a facsimile machine, a multifunction image forming apparatus, etc., which are made up of the above-mentioned essential portions, a portion (device) or portions (devices) other than the essential portions, a housing, etc.

The well-known subjects, such as the structure of the image forming apparatus, power sources, componential devices, control, etc., of the image forming apparatus disclosed in Japanese Laid-open Patent Application H09-230693 will not be illustrated to prevent the repetition of the same descriptions.

Embodiment 1

Figure 1:
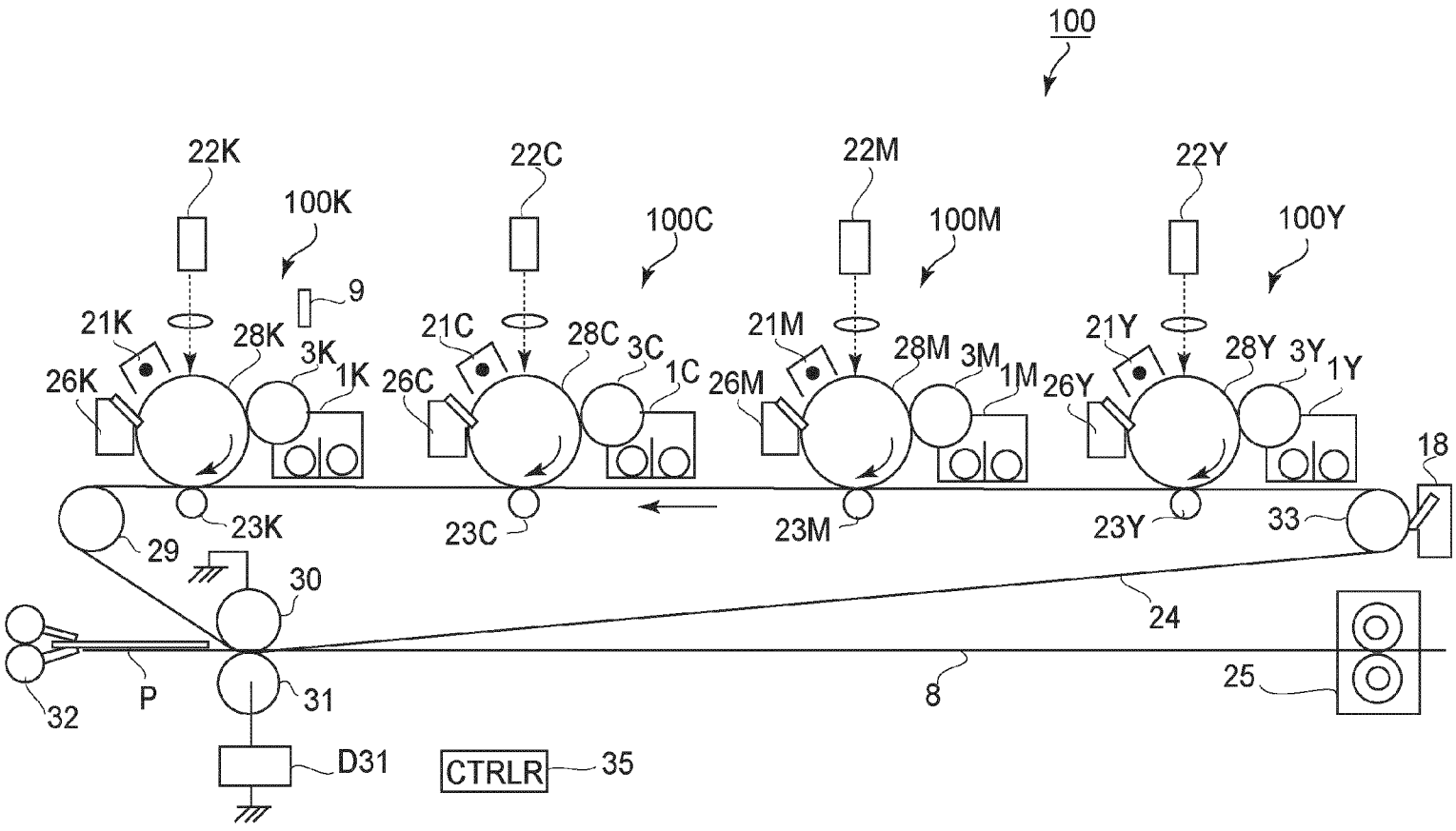
FIG. 1 is a schematic sectional view of the image forming apparatus in the first embodiment of the present invention, showing the general structure of the apparatus.
Figure 2:
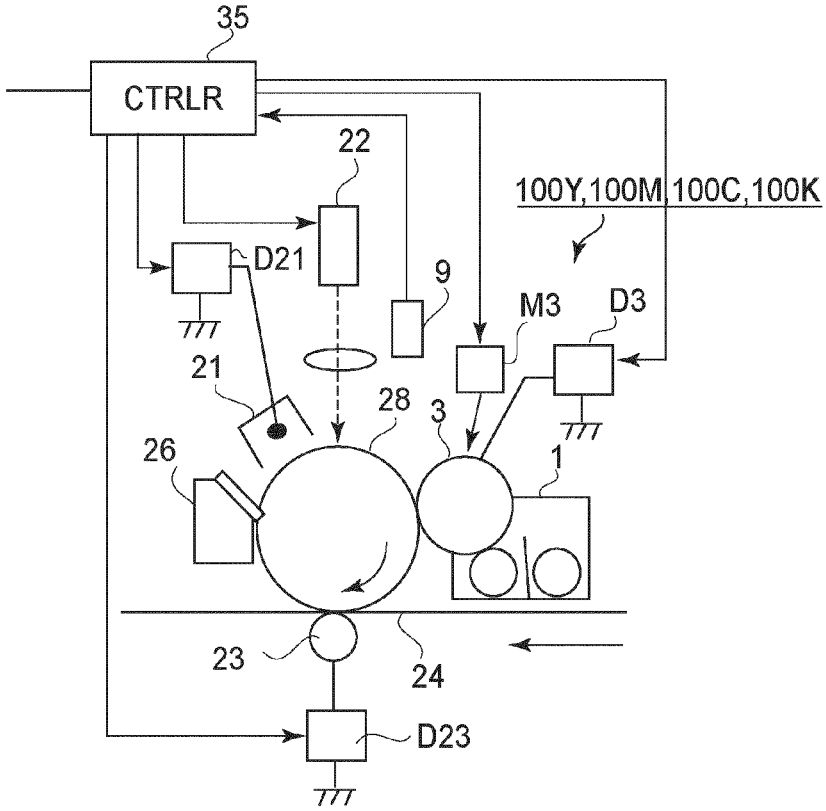
FIG. 2 is a schematic sectional view of the image forming portion of the image forming apparatus shown in FIG. 1.

FIG. 1 is a schematic sectional view of the image forming apparatus in the first embodiment of the present invention, and shows the structure of the apparatus. FIG. 2 is a schematic sectional view of the image forming portion of the image forming apparatus, and shows the structure of the image forming portion. The image forming apparatus 100 is a full-color image forming apparatus of the so-called tandem type. More specifically, it has yellow, magenta, cyan, and black image forming portions 100Y, 100M, 100C, and 100K, which are arranged in tandem between the upstream and downstream portion of the straight top portion of the loop which the intermediary transfer belt 24 forms. The image forming apparatus 100 forms a full-color image (made up of four monochromatic toner images different in color) on a recording medium P, such as a sheet of recording paper, plastic film, fabric, etc., in response to the pictorial signals sent from an original reading apparatus connected to the image forming apparatus 100, or a host device, such as a personal computer, connected to the image forming apparatus 100 so that communication is possible between the host device and the image forming apparatus 100.

Referring to FIG. 1, the image forming portions 100Y, 100M, 100C, and 100K form yellow, magenta, cyan, and black monochromatic toner images, respectively, and sequentially transfer the images in layers onto the intermediary transfer belt 24.

The intermediary transfer belt 24, which is an example of an intermediary transfer member, is stretched around a driver roller 29, a follower roller 33, and an inside secondary transfer roller 30, being thereby suspended by the three rollers. The intermediary transfer belt 24 is circularly driven by the driver roller 29 in the direction indicated by an arrow mark in the drawing. An outside secondary transfer roller 31 is kept pressed against the aforementioned inside secondary transfer roller 30, with the presence of the intermediary transfer belt 24 and a recording medium conveying member 8 between the two rollers 30 and 31, forming thereby the secondary transfer portion between the intermediary transfer belt 24 and recording medium conveying member 8.

The image forming apparatus 100 is fitted with an unshown sheet feeder cassette, in which a substantial number of recording mediums P are stored. The recording mediums P are fed one by one from the sheet feeder cassette into the main assembly of the image forming apparatus 100. As each recording medium P is fed into the main assembly, it is sent into the secondary transfer portion by the recording medium conveying member 8. As an electrical power source D31 applies secondary transfer voltage to the outside secondary transfer roller 31, the combination of the four color toner images, different in color, which make up a single full-color image on the intermediary transfer belt 24, are transferred together (secondary transfer) onto the surface of the recording medium P which is being moved together with the toner images, while remaining pinched by the intermediary transfer belt 24 and recording medium P, through the secondary transfer portion. After the transfer (secondary transfer) of the four toner images different in color, which makes up the single full-color image, onto the recording medium P, the recording medium P is conveyed by the recording medium conveying member 8 to a fixing apparatus 25, in which the four toner images (single full-color image) are subjected to heat and pressure. As a result, the four toner images become fixed to the surface of the recording medium P, yielding a single permanent full-color image on the recording medium P.

The image forming portions 100Y, 100M, 100C, and 100K, which are in the main assembly of the image forming apparatus 100, are practically the same in structure, although they are different in the color (yellow, magenta, cyan, or black) in which they develop a latent image. Thus, their structure will be described with reference to FIG. 2, in which the referential letters "Y, M, C, and K", which show the identity of the image forming portions, are not shown.

Referring to FIG. 2, each of the image forming portions 100Y, 100M, 100C, and 100K has a photosensitive drum 28, which is an example of an image bearing member. The photosensitive drum 28 is an electrophotographic photosensitive member, and is rotationally driven in the direction indicated by an arrow mark in the drawing. Each image forming portion has a charging device 21, an exposing apparatus 22, a developing device 1, and a drum cleaning apparatus 26, which are fixedly arranged in the adjacencies of the peripheral surface of the photosensitive drum 28. In the first embodiment, an electrostatic latent image is developed in reverse. That is, the charged portion of the peripheral surface of the photosensitive drum 28 is exposed so that the exposed points of the charged portion lower in potential level, and toner is adhered to the exposed points, that is, the points which are lower in potential level.

As the charging device 21, which is an example of charging means, is supplied with the negative voltage, which drives the charging device 21, from an electric power source D21, it uniformly charges the peripheral surface of the photosensitive drum 28 to the negative polarity.

The exposing apparatus 22 (laser scanner), which is an example of exposing means, exposes the charged portion of the peripheral surface of the photosensitive drum 28. More specifically, it emits a beam of laser light from its semiconductor laser element while modulating (PWM) the beam with the pictorial signals inputted from the aforementioned source, and reflecting the beam with a rotating mirror so that the beam will be oscillated in the manner to scan the peripheral surface of the photosensitive drum 28 in the direction parallel to the axial line of the photosensitive drum 28. Thus, each portion (point) of the peripheral surface of the photosensitive drum 28, which corresponds to a picture element of each of monochromatic images into which the optical image of an original (or intended image) are separated, and which is to be higher in density, is exposed by a greater area than each portion (point)

of the peripheral surface of the photosensitive drum 28, which corresponds to a picture element of each monochromatic image, which is to be lower in density. As a result, an electrostatic latent image is effected on the peripheral surface of the photosensitive drum 28, which is lower in the potential level on each point of the peripheral surface of the photosensitive drum 28, to which toner is to be adhered than on each point to which toner is not to be adhered.

The developing device 1, which is an example of a developing means, develops an electrostatic latent image on the peripheral surface of the photosensitive drum 28, by bearing the negatively charged toner therein, on the peripheral surface of its development sleeve 3 (which is an example of developer bearing member).

The development sleeve 3 is driven by a motor M3, the revolution of which can be set to two different values by a controller 35. It is positioned so that there is a slight gap between its peripheral surface and the peripheral surface of the photosensitive drum 28. To the development sleeve 3, development voltage, which is a combination of negative DC voltage and AC voltage, is applied from an electrical power source D3. As the development voltage is applied to the development sleeve 3, the negatively charged toner particles jump out of the development layer on the development sleeve 3 in response to the AC voltage in the development voltage, and adhere to the negatively charged points (FIG. 6) of the electrostatic latent image on the peripheral surface of the photosensitive drum 28, the potential level of which is on the positive side of the potential level of the DC voltage of the development voltage. That is, the positively charged toner particles adhere to the numerous exposed points of the peripheral surface of the photosensitive drum 28. In other words, the latent image on the photosensitive drum 28 is reversely developed into a toner image.

The primary transfer roller 23, which is an example of transferring means, is kept pressed against the peripheral surface of the photosensitive drum 28, with the intermediary transfer belt 24 remaining pinched between the primary roller 23 and photosensitive drum 28. As positive DC voltage (transfer voltage) is applied to the primary transfer roller 23 from an electric power source D23, the primary transfer roller 23 attracts the negatively charged toner image on the peripheral surface of the photosensitive drum 28, moving thereby the negatively charged toner image onto the intermediary transfer belt 24.

The controller 35, which is an example of controlling means, is enabled to control the above-described members, electric power sources, componential devices, etc., so that the image forming apparatus 100 operates in the first mode, which is the full-color mode, and the second mode, which is the black monochromatic mode.

As an image forming operation is started, first, the peripheral surface of the rotating photosensitive drum 28 is uniformly charged by the charging device 21. Then, the uniformly charged portion of the peripheral surface of the photosensitive drum 28 is exposed by the beam of laser light emitted by the exposing apparatus 22 while being modulated with pictorial signals. As a result, an electrostatic latent image is effected on the peripheral surface of the photosensitive drum 28. Then, the electrostatic latent image on the photosensitive drum 28 is developed by the developing device 1 into a visible image, that is, an image formed of toner. Then, the toner image on the photosensitive drum 28 is transferred (primary transfer) onto the intermediary transfer belt 24 by the transfer voltage applied to the primary transfer roller 23. After the transfer (primary transfer) of the toner image, the transfer residual toner, that is, the toner remaining on the peripheral surface of the photosensitive drum 28, is removed by the drum cleaning apparatus 26.

When the image forming apparatus 100 is in the full-color mode, the above-described image formation sequence is sequentially carried out in the image forming portions 100Y, 100M, 100C, and 100K, and the resultant monochromatic toner images, different in color, are sequentially transferred (primary transfer) in layers onto the intermediary transfer belt 24. Then, the four monochromatic toner images, different in color, on the intermediary transfer belt 24 are transferred together (second transfer) by the second transfer voltage applied to the inside secondary transfer roller 30, onto the recording medium P on the recording medium conveying member 8.

Next, the recording medium P is separated from the recording medium conveying member 8, and is sent to the fixing apparatus 25, which is an example of fixing means. The four monochromatic toner images, different in color, on the recording medium P, are subjected to heat and pressure, by the fixing apparatus 25, whereby the four toner images melt and mix, turning into a single full-color toner image. Then, as the single full-color toner image cools down, it becomes fixed to the recording medium P. Thereafter, the recording medium P is discharged from the image forming apparatus 100. The toner particles in the single full-color toner image on the intermediary transfer belt 24, which did not transfer onto the recording medium P in the secondary transfer portion, that is, the toner particles remaining on the intermediary transfer belt 24 after the secondary transfer, are removed by a belt cleaning apparatus 18, ending the image formation sequence carried out for yielding a single full-color copy.

When the image forming apparatus 100 is in the black monochromatic mode, the image forming portions 100Y, 100M, and 100C do not form a toner image. Thus, only the black toner image, that is, the toner image formed by the image forming portion 100K, is transferred (primary transfer) onto the intermediary transfer belt 24. This black toner image on the intermediary transfer belt 24 is transferred (secondary transfer) onto the recording medium P and fixed, as are the four monochromatic toner images, different in color, when the image forming apparatus 100 is in the full-color mode.

<Developing Device>

Figure 3:
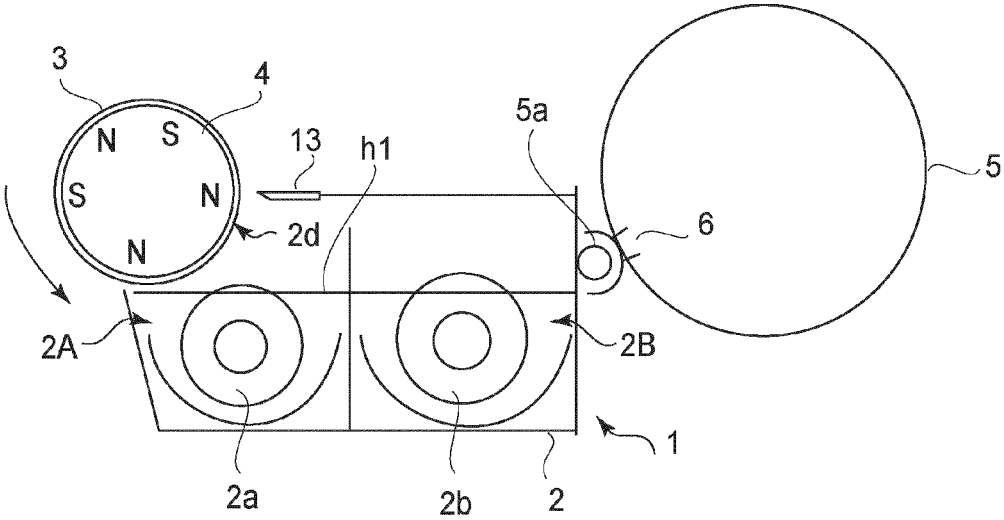
FIG. 3 is a schematic sectional view of the developing apparatus of the image forming apparatus in FIG. 1, which is parallel to the front panel of the apparatus.
Figure 4:
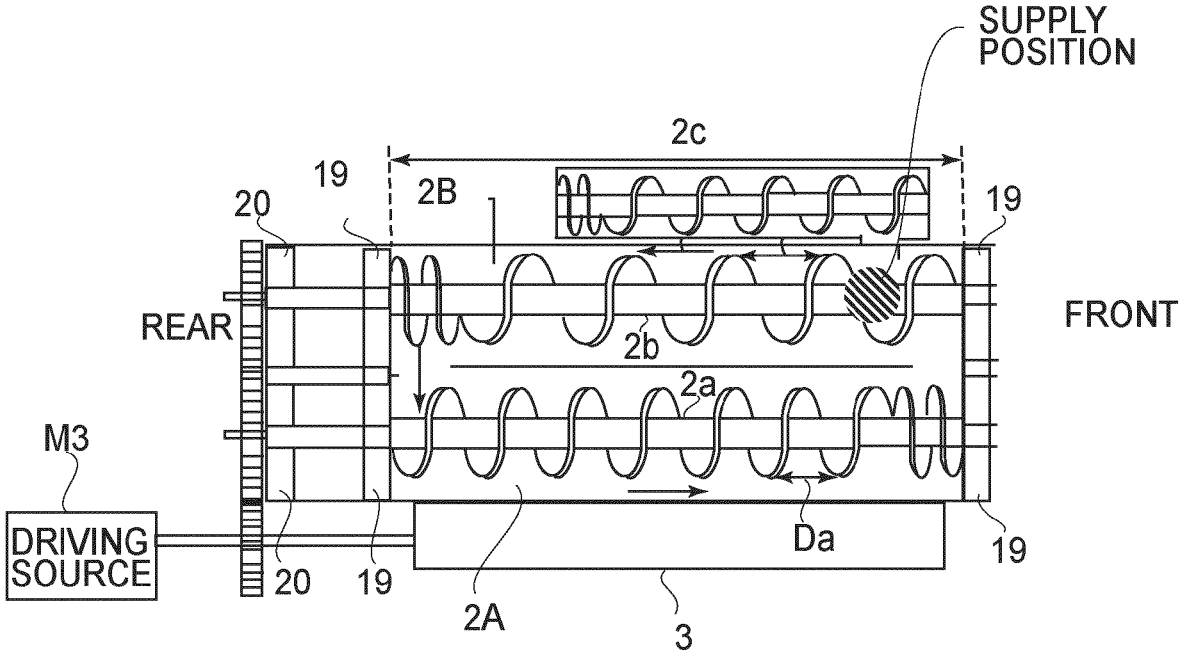
FIG. 4 is a schematic horizontal sectional view of the developing apparatus.
Figure 5:
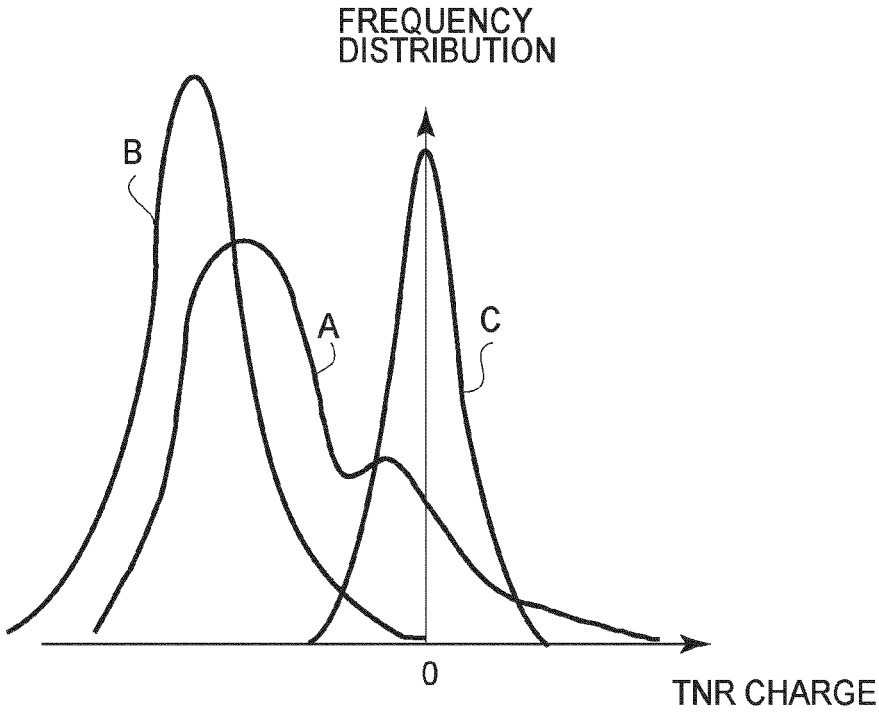
FIG. 5 is a graph which shows the particle distribution of the toner in the two-component toner, in terms of the amount of electric charge.

FIG. 3 is a schematic sectional view of the developing device, at a plane parallel to the front panel of the image forming apparatus 100. FIG. 4 is a schematic horizontal sectional view of the developing device. FIG. 5 is a graph which shows the toner particle distribution of the two-component toner, in terms of the amount of electric charge. The developing device 1 stores two-component developer, which is a mixture of nonmagnetic toner and magnetic carrier. Before a body of the developer in this embodiment is used for the first time, its toner concentration is 7%. Incidentally, the toner concentration needs to be adjusted according to the amount of toner charge, carrier particle diameter, structure of an image forming apparatus, and the like factors; it does not need to be limited to 7%.

Referring to FIG. 3, the developing device 1, which is an example of developing means, has the development sleeve 3 for conveying developer to the photosensitive drum 28. The development sleeve 3 is positioned so that it is partially exposed from the housing of the developing device 1, through the opening 2*d* of the housing, and faces the photosensitive drum 28. It is rotatably supported. In this first embodiment, the image forming apparatus 100 is provided with first and second developing apparatuses. The first developing apparatus means each of the yellow, magenta, and cyan developing devices 1Y, 1M, and 1C, respectively, and the second developing apparatus means the black developing device 1K. Thus, the first mode in which all developing devices, that is, developing devices 1Y, 1M, 1C, and 1K are used corresponds to the full-color mode, whereas the second mode in which only the black developing device 1K is used corresponds to the black monochromatic mode.

The development sleeve 3, which is an example of developer bearing member, is made up of a nonmagnetic substance. The developing device 1 also has a stationary magnet 4, as an example of magnetic field generating means, which is in the hollow of the development sleeve 3. During development, the development sleeve 3 rotates in the direction indicated by an arrow mark. The developing device 1 is also provided with a doctoring blade 13 made up of a magnetic substance. It is positioned so that its functional edge opposes one of the magnetic poles of the stationary magnet 4, which is for regulating the thickness of the developer layer, with the presence of a preset amount of gap between the doctoring blade 13 and the peripheral surface of the development sleeve 3. The functional edge of the doctoring blade 13 is the same in polarity as the magnetic pole which it opposes. As the development sleeve 3 rotates, the two-component developer in the developing device 1 is borne on the peripheral surface of the development sleeve 3, and is conveyed to the development area while being regulated in thickness by the doctoring blade 13, being thereby formed into a thin layer of developer of a preset thickness. Also as the development sleeve 3 rotates, the portion of the thin layer of developer, which is on a given portion of the peripheral surface of the development sleeve 3, is moved by the rotation of the development sleeve 3, into the development area, that is, the area in which the distance between the peripheral surfaces of the development sleeve 3 and photosensitive drum 28 is smallest, and in which the portion of the thin layer of developer, responds to the magnetic field generated by the magnet 4, cresting thereby in the form of the tip of a brush (magnetic brush). As a result, the electrostatic image on the peripheral surface of the photosensitive drum 28 is developed by the magnetic brush, that is, the crested portion of the developer layer on the peripheral surface of the development sleeve 3. After the development of the electrostatic image, the portion of the developer layer, which developed the electrostatic image by coming into contact with the peripheral surface of the photosensitive drum 28, is conveyed further by the rotation of the development sleeve 3, and is recovered into the housing 2 (shell) of the developing device 1, which also functions as a developer reservoir.

During the development of the electrostatic image on the photosensitive drum 28, oscillatory bias, which is a combination of AC and DC voltages, is applied as the above-described development voltage to the development sleeve 3. That is, development voltage, which includes AC component, is applied to the development sleeve 3. The dark point potential level (potential level of unexposed point) of a latent image formed on the peripheral surface of the photosensitive drum 28, and the light point potential level (potential level of exposed point) of a latent image formed on the peripheral surface of the photosensitive drum 28, are between the highest and lowest levels of the oscillatory bias. Further, an alternating electric field, that is, an electric field which alternates in direction, is formed in the development area. Therefore, the toner particles and carrier particles in the magnetic brush portion of the developer layer on the development sleeve 3 vigorously vibrate. As a result, the toner particles become free from the electrostatic force which works between the toner particles and development sleeve 3, and between the toner particles and carrier particles, in the direction to keep them bound to each other. The toner particles having become free adhere to the numerous points of the electrostatic image on the photosensitive drum 28, by the amount proportional to the potential of the points; in other words, the electrostatic latent image is developed. Incidentally, not only does the above-mentioned AC component include ordinary AC voltage, but also, voltage that can be obtained by turning on and off DC voltage with preset intervals.

The amplitude (which is peak-to-peak voltage Vpp, or difference between highest and lowest voltage values) has a large effect upon the developmental efficiency of the developing device 1, that is, the efficiency with which the potential level of a given point of a latent image is neutralized in potential by the electric charge of toner. Increasing peak-to-peak voltage Vpp adds to the force of the electric field which enables the charged toner particles from freeing themselves from the electrostatic force which works between the toner particles and carrier particles in the direction to keep them bound to each other. Therefore, it increases the amount by which the toner particles free themselves (jump) from the carrier particles. In other words, increasing peak-to-peak voltage Vpp increases the development efficiency. On the other hand, reducing peak-to-peak voltage Vpp reduces the ratio by which toner particles remain bound to the carrier particles by the above-mentioned electrostatic force, reducing thereby the number of toner particles which can contribute to the development. Thus, it reduces the development efficiency. Reduction in developmental efficiency results in the formation of an image which is abnormal in density or the like. Therefore, generally, the magnitude of the peak-to-peak voltage of the development bias is set to a value that can provide satisfactory development efficiency. The setting of the peak-to-peak voltage Vpp in this embodiment will be described later in detail, since it relates to the gist of this patent application of the present invention.

The housing 2 of the developing device 1 is provided with a development chamber 2A and a stirring chamber 2B. The development chamber 2A is the first chamber, that is, the chamber next to the development sleeve 3, and the stirring chamber 2B is the second chamber, that is, the chamber on the opposite side of the first chamber (development chamber 2A) from the development sleeve 3. The developing device 1 is provided with first and second developer circulating screws 2*a* and 2*b*, which are disposed in the development chamber 2A and stirring chamber 2B, respectively. The two screws 2*a* and 2*b* are rotationally driven by a motor M3, as a driving force source, which is shared by the development sleeve 3. Thus, the two-component developer is circularly moved through the developer circulation path 2*c* as shown in FIG. 4, while being stirred (whereby fresh supply of toner is mixed with developer pre-existing in developing device 2). As for the direction in which the developer is circulated, in the stirring chamber 2B (on second developer circulation screw 2*b* side), the developer is moved in the front-to-rear direction, whereas in the development chamber 2A (on first developer circulation screw 2*a* side), the developer is moved in the rear-to-front direction. The second and first developer circulation screws 2*b* and 2*a* are rotatably supported by the front and rear sealing walls 19. The gear train for rotating the second and first toner circulation screws 2*b* and 2*a* together with the development sleeve 3 is positioned outside the rear external wall 20.

Referring to FIG. 3, a toner bottle 5 contains replenishment toner, which has not been electrically charged. As it is detected by an unshown magnetic sensor that the toner concentration of the two-component developer is below a preset referential level, a replenishment screw 5*a* is rotated to draw the uncharged toner from the toner bottle 5 through the toner outlet 6, and delivers the drawn uncharged toner to the toner inlet of the stirring chamber 2B shown in FIG. 4. The uncharged toner is moved rearward in the stirring chamber 2B while being stirred by the second developer circulation screw 2 together with the developer in the stirring chamber 2B, being thereby mixed with the developer in the stirring chamber 2B. Then, the mixture of the fresh supply of toner and the developer in the stirring chamber 2B is moved into the development chamber 2A. As for the particle distribution of the toner in the two-component developer in the development chamber 2A, in terms of the amount of electric charge, it is shown in FIG. 5, being represented by Line A. That is, it has a distinctive pattern. As for the particle distribution of the uncharged toner to be supplied from the toner bottle 5 in terms of the amount of electric charge, it is represented by Line C in FIG. 5. The peak of this distribution curve is near zero in terms of the amount of electric charge. The uncharged toner particles supplied from the toner bottle 5 need to be charged as they mix with the developer in the housing 2 of the developing device 1, by being stirred together with the developer by the second developer circulation screw 2*b*, so that its particle distribution curve in terms of the amount of electric charge becomes roughly the same as the particle distribution curve represented by Line B.

The amount of electrical charge of toner was measured with the use of an ESPART analyzer (Hosokawa Micron Co., Ltd.). An ESPART analyzer is an apparatus for measuring the particle diameter of a powdery substance and the amount of electric charge which the powdery substance has. It has a detecting portion (measuring portion) in which an electric field and an acoustic field are simultaneously created. A test sample of particulate substance is placed in the detecting portion, and the speed of the particles is measured using the laser Doppler method. Then, the particle diameter and the amount of electric charge of the particulate substance are calculated from the results of the measurement. More specifically, as the test sample of particulate substance is placed in the measuring portion of the apparatus, it is subjected to the acoustic field and electric field. Thus, the particles of the test sample fall while horizontally deviating. While the particles fall, the beat frequency of the particles in terms of the horizontal direction is counted. The count value is interruptedly inputted into a computer so that the particle distribution in terms of diameter, or the particle distribution, per unit particle diameter, in terms of the amount of electric charge, of the test sample is shown in realtime on the monitor of the computer. As a preset number of the particles of the test same are measured in the amount of electric charge, the monitor becomes still, and then, the three dimensional particle distribution in terms of the amount of electric charge and diameter, particle distribution in terms of the amount of electric charge, based on particle diameter, average amount of electric charge (coulomb/weight), etc., are displayed on the monitor. The relationship between particle diameter and amount of electric charge of toner can be evaluated from the characteristic of the toner in terms of chargeability, by measuring the amount of electric charge of the toner by placing the toner as a test sample of particulate substance in the measuring portion of the ESPART analyzer.

In order to obtain the particle distribution of the toner in the two-component developer in terms of the amount of electric charge, the two-component developer, which is the particulate substance to be measured in the amount of electric charge, was held by an electric magnet or the like, and was blown by air flow of a proper strength so that only the toner particles in the two-component developer remained on the electric magnet or the like; the toner particles were separated from the magnetic carrier. With the use of this method, it was possible to place only the toner in the two-component developer in the measuring portion of the ESPART analyzer, as a test particulate substance. The air pressure was adjusted to a proper level, that is, the level at which the toner was separated from the carrier in the two-component developer and the electric magnet, without separating the carrier from the electric magnet.

When measuring the amount of electric charge of the uncharged toner to obtain the particle distribution curve of the uncharged toner in terms of the amount of electric charge, no less than a preset number (value required for ESPART analyzer: 3,000 in this test) of uncharged toner particles, which were the object of measurement, were held by a medicine spoon, and were blown with air flow with a proper amount of pressure, so that the uncharged toner particles were placed as test particles in the measuring portion of the ESPART analyzer.

<Mixing of Black Toner Particles into Nonblack Toner Images in Full-Color Mode>

Figure 6:
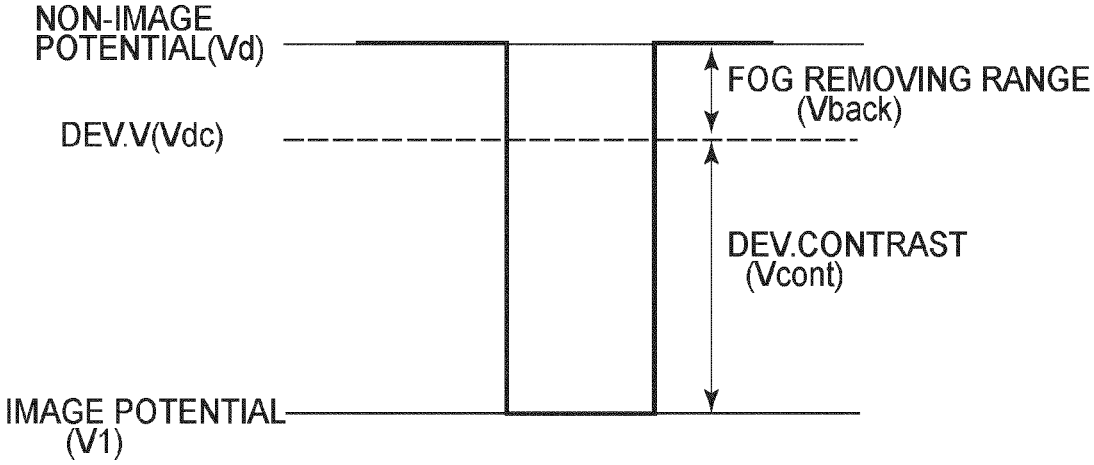
FIG. 6 is a schematic drawing which shows the relationship between the latent image contrast and development contrast.
Figure 7:
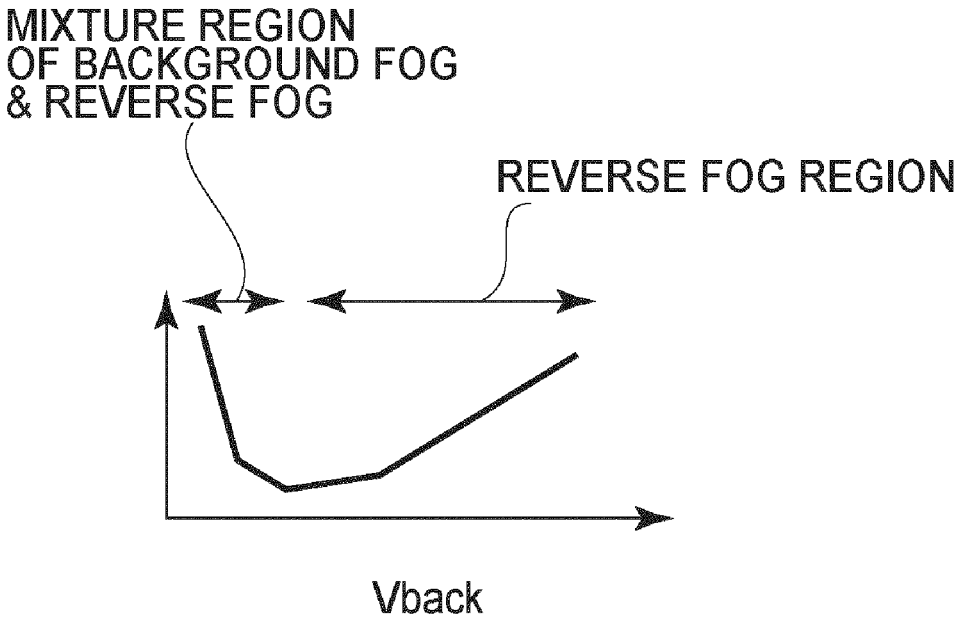
FIGS. 7(*a*) and 7(*b*) are graphs which show the relationship between the magnitude of the fog prevention potential and the amount of fog causing toner particles (both negatively charged particles and reversely charged particles), on the photosensitive drum 28, and the relationship between the magnitude of the fog prevention potential and the amount of fog causing toner particles (both negatively charged particles and reversely charged particles), on the intermediary transfer belt, respectively.
Figure 7:
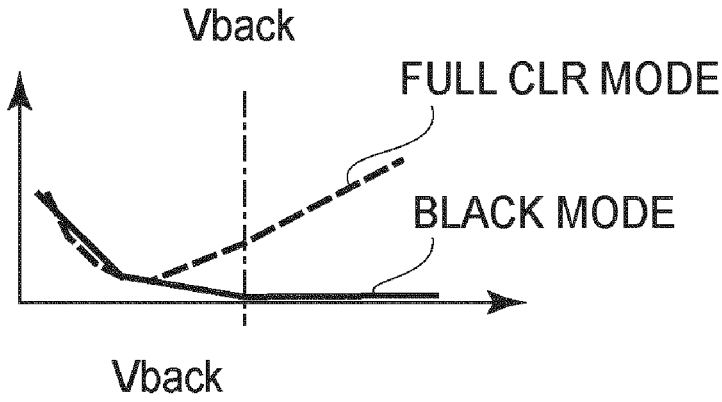

FIG. 6 is a schematic drawing which shows the relationship between the latent image contrast and development contrast. FIGS. 7(*a*) and 7(*b*) are graphs which show the relationship between the magnitude of the fog prevention potential and the amount of fog causing toner particles (both negatively charged particles and reversely charged particles), on the photosensitive drum 28, and the relationship between the magnitude of the fog prevention potential and the amount of fog causing toner particles (both negatively charged particles and reversely charged particles), on the intermediary transfer belt, respectively. FIG. 6 schematically shows the potential levels of the image portion and background portions of the electrostatic latent image formed on the photosensitive drum 28, and the absolute value of the DC component of the development voltage applied to the development sleeve 3. As described above, in the first embodiment, the peripheral surface of the photosensitive drum 28 is negatively charged, and an electrostatic latent image is formed on the peripheral surface of the photosensitive drum 28 by exposing the negatively charged portion of the peripheral surface of the photosensitive drum 28. Then, the electrostatic image is developed into a visible image, that is, a toner image, by adhering the negatively charged toner to the points of the electrostatic latent image, which were reduced in potential level by the exposure. The latent image contrast is the difference in potential level between the image portion (exposed points) and background portion (unexposed points) of the electrostatic latent image. Of the latent image contrast, the difference in potential level between the image portion and the DC component of the development voltage is the development contrast, and the difference in potential level between the background portion and the DC component of the development voltage is the fog prevention potential.

In the case of the image portion, the negatively and uniformly charged toner, which is normal in the particle distribution in terms of the amount of electric charge (Line B in FIG. 5) is pulled by the development contrast Vcont so that it is pressed upon the photosensitive drum 28, developing thereby the latent image on the photosensitive drum 28. The development contrast Vcont is the driving force which transfers the toner which is normal in the particle distribution in terms of the amount of electric charge, to the exposed points of the charged portion of the peripheral surface of the photosensitive drum 28, from the development sleeve 3.

On the other hand, in the case of the background portion, the negatively and uniformly charged toner, which is normal in particle distribution in terms of the amount of electric charge is pulled by the fog prevention potential Vback, being therefore pulled away from the photosensitive drum 28 and returned to the development sleeve 3. Therefore, the toner which is normal in the particles distribution in terms of the amount of electric charge is unlikely to remain adhered to the background portion. That is, as long as toner is negatively charged and normal in the particle distribution in terms of the amount of electric charge, it is unlikely to remain adhered to the background portion of the latent image; the so-called fog is unlikely to be formed.

However, there are occasions in which the particle distribution of the toner on the development sleeve 3 becomes the one represented by Line A in FIG. 5; the toner on the development sleeve 3 becomes charged so that it contains positively charged toner particles, that is, reversely charged toner particles. In a case where the toner on the development sleeve 3 contains reversely charged toner particles (which in first embodiment are positively charged toner particles), the reversely charged toner particles are pulled by the fog prevention potential Vback, shown in FIG. 6, in the opposite direction from the direction in which the normally charged toner particles, that is, the negatively charged toner particles, are pulled. That is, the reversely charged toner (positively charged toner particles) are separated from the development sleeve 3, and are pressed upon the photosensitive drum 28, by the fog prevention potential Vback, adhering thereby to the background portion of the latent image, creating thereby the so-called "reversed potential fog" on the peripheral surface of the photosensitive drum 28. The creation of the reversed potential fog creates the problem that when multiple monochromatic images which are different in color are layered to form a full-color image as in the first embodiment, the problem of unwanted color mixture occurs.

More specifically, it is assumed that when a full-color image is formed with the use of the image forming apparatus 100 in which yellow (Y), magenta (M), cyan (C), and black (K) toner images are sequentially transferred (primary transferred), the reversed potential fog is generated by the developing device K of the image forming apparatus 100. Thus, when the black toner image is transferred onto the intermediary transfer belt 24, the reversed potential fog of the black toner image will also transfer onto the yellow toner image on the intermediary transfer belt 24, making it possible that the reversely charged black toner particles will mix into the portion of the yellow toner image, which corresponds to the background portion of the black toner image on the photosensitive drum 28. The following is the explanation for the occurrence of this problem.

The transfer voltage, which is applied to the primary transfer roller 23K separates the normally charged toner particles from the photosensitive drum 28K and transfers them onto the intermediary transfer belt 24. It also separates the reversely charged toner particles from the intermediary transfer belt 24 and transfers them onto the photosensitive drum 28K. Therefore, the black toner particles having adhered to the points of the peripheral surface of the photosensitive drum 28K, which correspond to the image portion of the latent image, are transferred (primary transfer) onto the intermediary transfer belt 24, whereas the reversely charged toner particles (which cause reversed potential fog) remain on the photosensitive drum 28; they are not transferred onto the intermediary transfer belt 24.

However, when there is a yellow toner image on the intermediary transfer belt 24, the reversely charged toner particles (which cause reversed potential fog) having adhered to the points of the peripheral surface of the photosensitive drum 28K, which correspond to the background portion of the latent image, are opposite in polarity from the yellow toner image, onto which the black toner image having the reversely charged toner particles is to be transferred in layers. Therefore, once the black toner image comes into contact with the yellow toner image on the intermediary transfer belt 24, the reversely charged toner particles of the black toner image combine with the yellow toner particles of the yellow image on the intermediary transfer belt 24 because of the electrostatic force, making it impossible for the transfer voltage applied to the primary transfer roller 23K, to separate them. As a result, the reversely charged black toner particles (which causes reversed potential fog) remain adhered to the portions of the yellow toner image on the intermediary transfer belt 24, which corresponds to the portions of the peripheral surface of the photosensitive drum 28, which correspond to the background portions of the black toner image on the photosensitive drum 28, creating faint reversed potential fog across the above-mentioned portion of the yellow toner image. As a result, a full-color image suffers from the presence of unintended borderlines created by the difference in brightness between the adjacent two areas of the image.

The above-described problematic phenomenon is visually most conspicuous when reversely charged toner particles of a black toner image are transferred onto a yellow toner image as described above. However, the same phenomenon also occurs to the magenta and cyan toner images. FIGS. 7(*a*) and 7(*b*) show the relationship between the setting of the DC component of the development voltage and the amount of the reversely charge toner particles (which causes revered potential fog) on the photosensitive drum 28, and the relationship between the setting of the DC component of the development voltage and the amount of reversely charged toner particles (which causes reversed potential fog) transferred (primary transfer) onto the intermediary transfer belt 24, respectively. In the graphs, the horizontal axis represents the fog prevention potential Vback. Referring to FIG. 7(*a*), where the fog prevention potential Vback is small, the fog of the toner image formed on the photosensitive drum 28 include both the negatively charged toner particles (which causes normal potential fog) which are insufficient in the amount of charge, and the reversely charged toner particles (which causes reversed potential fog). However, where the fog prevention potential Vback is greater in magnitude than a certain value, the reversed potential fog, that is, the fog attributable to the reversely charged toner particles, is more conspicuous than the normal potential fog, that is, the fog attributable to the toner particles which are normal in polarity, but, insufficient in the amount of electric charge.

Referring to FIG. 7(*b*), in the black monochromatic mode, the reversed potential fog is not transferred onto the intermediary transfer belt 24. Therefore, even if the fog prevention potential Vback is increased, the problem regarding fog does not become serious.

In the full-color mode, however, the amount by which the toner particles which make an image appear foggy are formed in the image forming apparatuses 100Y, 100M, and 100C, which are on the upstream side of the image forming portion 100K, increased as the fog prevention potential Vback was increased as indicated by the broken line in FIG. 7(*b*). This phenomenon occurred, because the toner images, which are negative in polarity, were transferred onto the intermediary transfer belt 24, with the positively charged toner particles (which causes reversed potential fog) remaining electrostatically adhered, in mixture, to the negatively charged toner image. The fog causing reversely charged toner particles in the toner image made up of mostly negatively charged toner particles, are not separated from the negatively charged toner particles, in the secondary transfer portion; they are transferred (secondary transfer), together with the negatively charged toner particles, onto the recording medium P. However, if the fog prevention potential Vback is simply set to a smaller value in order to prevent the transfer of the fog causing reversely charged toner particles, the fog attributable to the toner particles which are normal in polarity, but, is insufficient in the amount of electric charge amount naturally becomes more conspicuous, than the reversed potential fog, as shown in FIG. 7(*b*).

Figure 8:
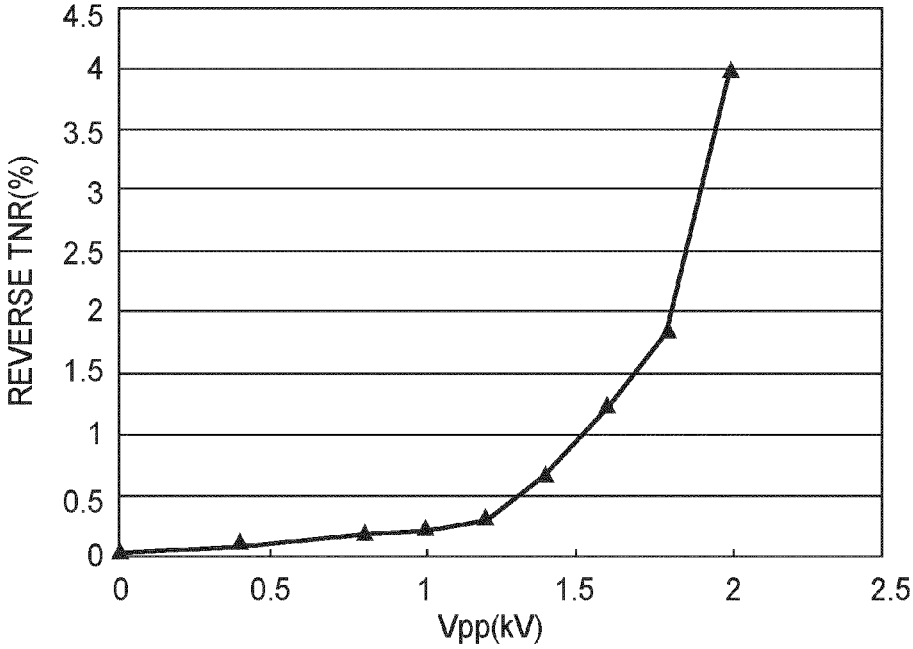
FIG. 8 is a graph which shows the relationship between the peak-to-peak voltage of the AC component of the development voltage, and the amount by which the toner particles on the development sleeve become reversely charged.
Figure 9:
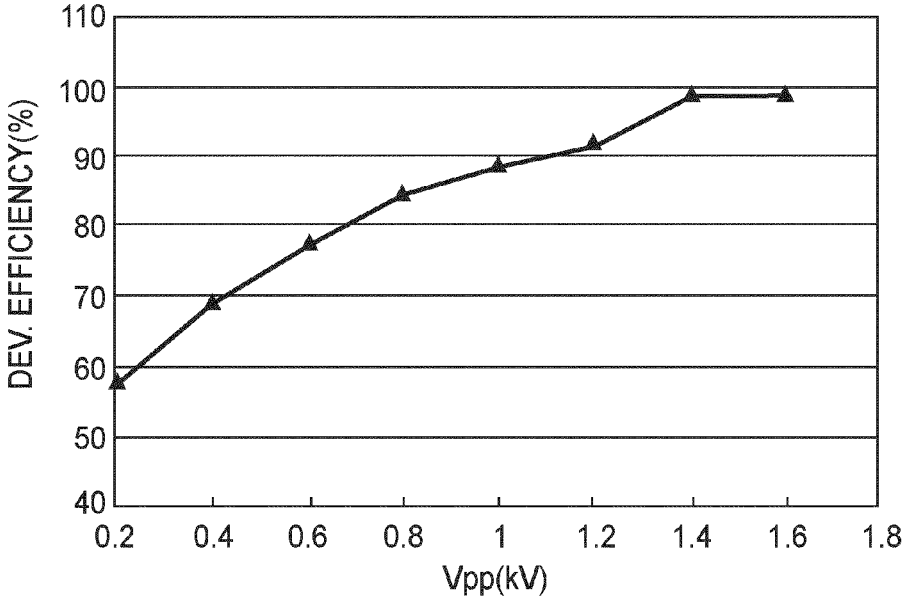
FIG. 9 is a graph which shows the relationship between the peak-to-peak voltage of the AC component of the development voltage, and the developmental efficiency of the developing device.
Figure 10:
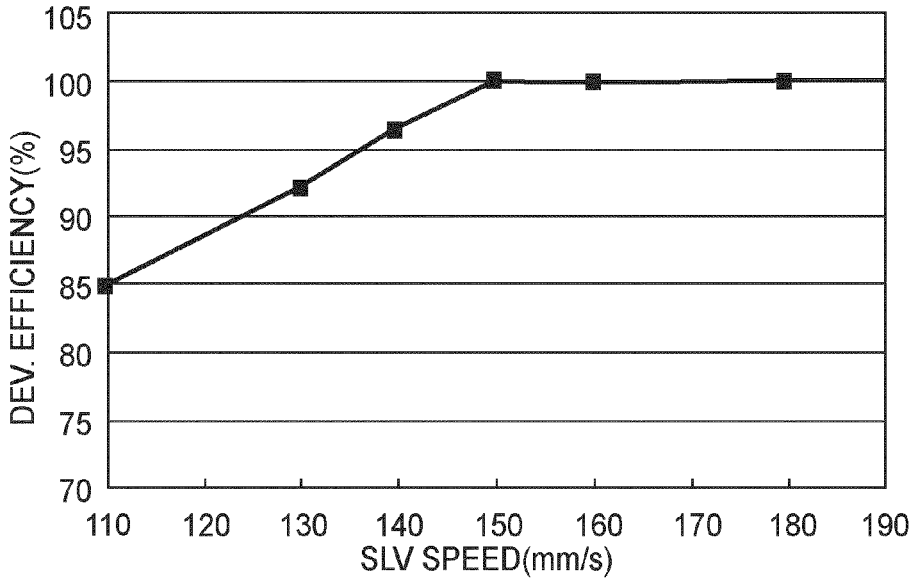
FIG. 10 is a graph which shows the relationship between the peripheral velocity of the development sleeve and developmental efficiency.
Figure 11:
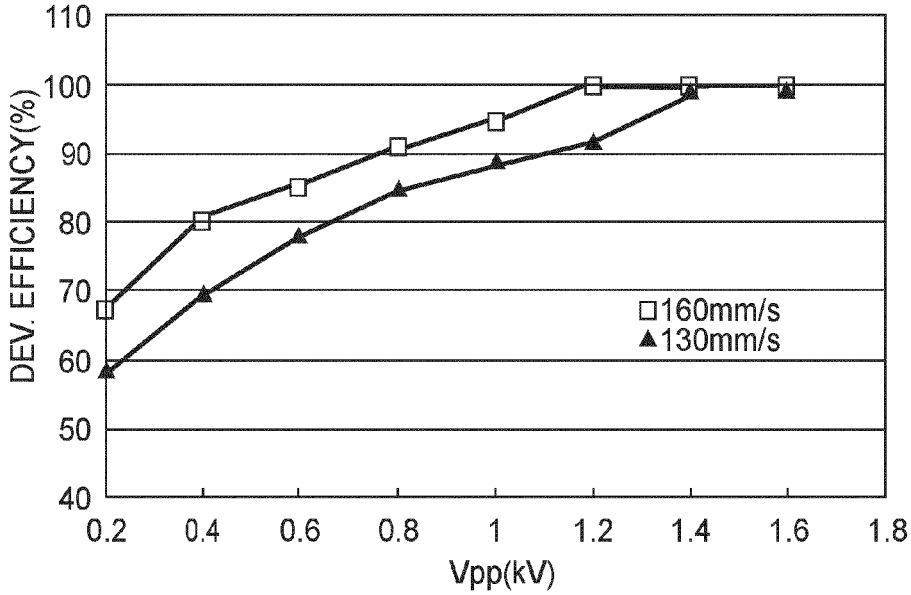
FIG. 11 is a graph which shows the relationship among the peak-to-peak voltage of the AC component of the development voltage, developmental efficiency, and peripheral velocity of the development sleeve.

FIG. 8 is a graph which shows the relationship between the peak-to-peak voltage of the AC component of the development voltage, and the amount by which the toner becomes reversely charged. FIG. 9 is a graph which shows the relationship between the peak-to-peak voltage of the AC component of the development voltage, and the developmental efficiency of the developing device. FIG. 10 is a graph which shows the relationship between the peripheral velocity of the development sleeve and developmental efficiency. FIG. 11 is a graph which shows the relationship among the peak-to-peak voltage of the AC component of the development voltage, developmental efficiency of the developing device, and peripheral velocity of the development sleeve.

In the first embodiment, the developing device 1 was switched in control based on whether the image forming apparatus 100 is in the full-color mode which requires multiple monochromatic images to be layered in alignment, and therefore, is likely to cause the image forming apparatus 100 to yield an image which suffers from conspicuous reversed potential fog, that is, the fog attributable to reversely charged toner particles, or the image forming apparatus 100 is in the black monochromatic mode which does not require multiple monochromatic images to be layered. Therefore, the problematic phenomenon that reversely charged toner particles (which causes reversed potential fog) are transferred onto the normal toner image(s) and remain adhered thereto, is prevented without the provision of an apparatus, such as the one disclosed in Japanese Laid-open Patent Application H09-230693, dedicated to the recovery of the toner particles responsible for the formation of reversed potential fog, making it possible to form an excellent image.

First, the cause of the generation of reversely charged toner particles which are responsible for the formation of revered potential fog will be described in detail. Referring to FIG. 4, uncharged toner is conveyed through the developer circulation path 2*c* while being stirred together with the carrier in the developer which was in the developing device 1. Thus, while the uncharged toner is conveyed through the developer circulation path 2*c*, not only is it mixed with the carrier, but also, it is electrically charged. In other words, while the uncharged toner is conveyed through the developer circulation path 2*c*, the pattern of the particles distribution of the uncharged toner in terms of electric charge becomes as represented by Line B in FIG. 5, that is, normal. However, as the developing device 1 increases in the cumulative length of operation, the carrier therein eventually reduces in its ability to charge toner, failing thereby to give the toner a satisfactory amount of tribo-electrical charge by being stirred together with the toner. In other words, when the developer in the developing device 1 is relatively new, the frequency with which toner particles are reversely charged is low. Therefore, when it was found that the body of two-component developer, which was being delivered to the development area by the development sleeve 3 contained a significant amount of reversely charged toner particles and/or normally, but, insufficiently charged toner particles, it was determined that the carrier in the developing device 1 had reached the end of its life, and the problems attributable to the reversely charged toner particles were satisfactorily eliminated by replacing the developer in the developing device 1 along with the developing device 1.

However, the earnest studies conducted by the inventors of the present invention regarding this phenomenon revealed the following: In a case where black toner, the coloring agent of which is pigment made up of carbon which is low in electrical resistance, is used, toner particles become reversely charged even in areas other than the developer circulation path 2*c*. It was also revealed that when the development voltage is under a certain condition, the negatively charged toner particles in the two-component developer on the development sleeve 3 sometimes become positively charged while being moved through the development area. As the negatively charged toner particles are subjected to the electric field (pull-back development field), which renders the photosensitive drum 28 negative in potential relative to the development sleeve 3, positive electric charge is injected into the negatively and uniformly charged toner, sometimes causing thereby some of the negative charged toner particles in the toner to become positively (reversely) charged.

The phenomenon that positive electric charge is injected into the negatively charged toner particles in the development area becomes more conspicuous as the peak-to-peak voltage Vpp of the AC component of the development voltage is increased. In other words, the greater the peak-to-peak voltage Vpp, the greater the amount by which negatively charged toner particles are changed in polarity, that is, become positively charged; the toner particles responsible to the formation of reversed potential fog increases in number. In a case where an oscillating voltage, which is a combination of DC and AC components and is rectangular in waveform, is used as the development bias, the increase in the peak-to-peak voltage of the AC component results in the increase in the amount of reversely charged toner. That is, the increase in the peak-to-peak voltage Vpp results in the increase in the amount by which the negatively charged toner particles become positively charged, which results in increase in the amount of the reversed potential fog. On the contrary, if the peak-to-peak voltage Vpp is set to a relatively small value, the amount by which the normally (negatively) charged toner particles become reversely (positively) charged while they are on the development sleeve 3. Therefore, it virtually never happens that fog is created by the reversely charged toner particles, even if the fog prevention potential Vback is kept the same.

FIG. 8 presents the data regarding the values to which the peak-to-peak voltage Vpp was set, and the amount of the reversed potential fog. The amount of the reversely charged toner in FIG. 8 is the ratio (%) of the number of reversely charged toner particles in the total amount of toner measured with the use of the ESPART analyzer. When the data shown in FIG. 9 were obtained, the peripheral velocity of the peripheral surface 28 was 100 mm/sec, and the peripheral velocity of the development sleeve 3 was 130 mm/sec.

Referring to FIG. 8, when the peak-to-peak voltage Vpp was kept below 1.2 kV, the amount by which the normally charged toner particles became reversely (positively) charged was extremely small. Therefore, the formation of the reversed potential fog attributable to the electrostatic adhesion between the toner image on the intermediary transfer belt 24, and the fog causing reversely charged toner particles, scarcely occurred. Incidentally, the results of the measurement, which are shown in FIG. 8 are the results obtained when the peripheral velocity of the development sleeve 3 was 130 mm/sec. However, even when the peripheral velocity of the development sleeve 3 was increased to 200 mm/sec, the results remained virtually the same as those obtained when the peripheral velocity of the development sleeve 3 was 130 mm/sec. The reversed potential fog attributable to the application of AC component of the development voltage to the developer in the development area is caused the injection of positive electric charge. Therefore, the amount by which the reversed potential fog is created is significantly affected by the peak-to-peak voltage Vpp of the AC component of the development voltage, and the electrical resistance of toner.

FIG. 9 shows the values to which the peak-to-peak Vpp was set, and the measured developmental efficiency of the developing device 1. When the developmental efficiency was measured, the peripheral surface of the photosensitive drum 28 and the peripheral velocity of the development sleeve 3 were 100 mm/sec and 130 mm/sec, respectively. Since the developmental efficiency is affected by the magnitude of the peak-to-peak voltage Vpp, the peak-to-peak voltage Vpp is to be set to a value in the range in which the developing device 1 remains efficient in developmental performance.

Referring to FIG. 9, the greater the peak-to-peak voltage Vpp, the higher the developmental efficiency. Therefore, if the flow of the positive electric charge in the development area, to which the formation of the reversed potential fog is attributable, is reduced by setting the peak-to-peak voltage Vpp to a smaller value based on the results of measurement given in FIG. 8, the developing device 1 will be slightly reduced in developmental efficiency.

Incidentally, as for the method for measuring the developmental efficiency, first, the potential level V1 of the portion of the peripheral surface of the photosensitive drum 28, which corresponds to the image portion of the latent image was measured, and then, the potential level Vt of the toner after the development. Then, the quotient obtained by dividing the difference in potential level between the image portion potential level V1 and toner potential level Vt, by the development contrast Vcont is used as the developmental efficiency. Therefore, if the post-development toner potential level Vt converges to Vdc of the development bias, developmental efficiency ((V1−Vt)/Vcont) is 100%, because V1−Vt=Vcont. The surface potential level of the photosensitive drum 28, and the surface potential level of the developed toner image, were measured with the use of a surface potentiometer Model 344 and a dedicated probe (Trek Co., Ltd.).

FIG. 10 shows the developmental efficiency of the developing device 1, which was measured, with the peripheral velocity of the photosensitive drum 28 kept at 100 mm/sec while varying the peripheral velocity of the development sleeve 3K in the range of 110-180 mm/sec. The AC component of the development voltage was 12 kHz in frequency, rectangular in waveform, and 1.2 kV in peak-to-peak voltage Vpp.

It is evident from FIG. 10 that increasing the peripheral velocity of the development sleeve 3K increases the developmental efficiency of the developing device 1. The reason for this effect may be thought to be as follows: Increasing the peripheral velocity of the development sleeve 3K increases the amount by which toner is carried to the developing area per unit length of time, adding thereby to the amount of toner capable of contributing to development. Therefore, even though the peak-to-peak voltage Vpp was kept at the same level, the developing device 1 was increased in developmental efficiency. Further, this result means that even if the peak-to-peak voltage Vpp, which has significant effect on the developmental efficiency, is reduced, the developing device 1 does not reduce in developmental efficiency, as long as the reduction in the amount of toner capable of contributing to development, which is caused by the reduction in the amount of peak-to-peak voltage Vpp, is compensated by the increase in the peripheral velocity of the development sleeve 3K.

FIG. 11 shows the changes in the developmental efficiency of the developing device 1, which were measured, with the peripheral velocity of the development sleeve 3K set at 160 mm/sec, to which it was increased from 130 mm/sec, while varying the peak-to-peak voltage Vpp.

It is evident from FIG. 11 that as the peak-to-peak voltage Vpp was reduced to 1.2 kV from 1.6 kV when the peripheral velocity of the development sleeve 3K was 130 mm/sec, the developmental efficiency declined from 100% to roughly 90%. However, the reduced developmental efficiency was restored to 100%, that is, the efficiency prior to the reduction in the peripheral velocity, by increasing the peripheral velocity of the development sleeve 3K to 160 mm/sec.

In the first embodiment, the characteristics of the developing device 1, which are shown by FIGS. 8 and 11 are utilized. That is, the full-color mode is made different from the black monochromatic mode in the setting of the peak-to-peak voltage Vpp of the development voltage of the developing device 1 and the peripheral velocity of the development sleeve 3K of the developing device 1; the peak-to-peak voltage Vpp and peripheral velocity were set as shown in Table 1. By setting the peak-to-peak voltage Vpp and peripheral velocity as shown in Table 1, the reduction in image quality, which are attributable to the reversed potential fog, was prevented without causing such problems as the reduction in developmental efficiency and premature deterioration of developer.

TABLE 1

| | | 1Y | 1M | 1C | 1K |
|---|---|---|---|---|---|
| Full Clr | p-t-p | 1.6 kV | 1.6 kV | 1.6 kV | 1.2 kV |
| | Freq. | 130 mm/s | 130 mm/s | 130 mm/s | 160 mm/s |
| Blk Mono. | p-t-p | 1.6 kV | 1.6 kV | 1.6 kV | 1.6 kV |
| | Freq. | 130 mm/s | 130 mm/s | 130 mm/s | 130 mm/s |

The pigment used as the coloring agent for black toner is carbon, which is low in electrical resistance. Thus, black toner tends to reverse in polarity during development. Therefore, in the full-color mode in which the reversed potential fog attributable to the electrostatic adhesion of the reversely charged toner particles to the toner image on the intermediary transfer belt 24 is likely to be conspicuous, the peak-to-peak voltage Vpp of the AC component of the development voltage was set to 1.2 kV. In other words, in the full-color mode, the prevention of the problem that the toner particles on the development sleeve 3K of the black developing device 1K are reversed in polarity while they were moved through the development area was prioritized for the prevention of the formation of the reversed potential fog attributable to the reversely charged toner particles. The reduction in the developmental efficiency, which would have been caused by the reduction in the peak-to-peak voltage Vpp, was cancelled by increasing the peripheral velocity of the development sleeve 3K to 160 mm/sec.

On the other hand, in the black monochromatic mode, no matter how many toner particles are reversed in polarity in the development area, most of the reversely charged toner particles are not transferred onto the intermediary transfer belt 24. Further, even if revered potential fog is caused on the photosensitive drum 28 by the reversely charged toner particles, the positively (reversely) charged toner particles, that is, the toner particles which changed in polarity, are subjected to the force which works in the direction to pull them back to the photosensitive drum 28, when they are transferred (primary transfer). Therefore, the peak-to-peak voltage Vpp of the AC component of the development voltage was set to a slightly higher value, that is, 1.6 kV, in order to increase the transfer efficiency, prioritizing thereby keeping the peripheral velocity of the development sleeve 3K at 130 mm/sec.

In the black monochromatic mode, the peak-to-peak voltage Vpp was set to a value higher than in the full-color mode. Therefore, even though the peripheral velocity of the development sleeve 3K was kept at the 130 mm/sec, the developmental efficiency remained virtually the same as that in the full-color mode. Further, since the peripheral velocity of the development sleeve 3K was set to a lower value, the development sleeve 3K was smaller in the number of times it needed to be rotated to output each copy, reducing thereby the amount of frictional deterioration of developer, which occurs in the gap between the peripheral surface of the development sleeve 3K and the doctor blade 13 (FIG. 3).

That is, even though the black monochromatic mode was rendered the same as the full-color mode, in peak-to-peak voltage Vpp of the development voltage (for developing latent image for forming black toner image) and the peripheral velocity of the development sleeve 3 (3K), the black monochromatic mode did not suffer from the problem regarding the reversed potential fog attributable to the reversely charged toner particles and the reduction in the developmental efficiency. However, the black monochromatic mode is higher in the frequency with which an image forming apparatus is used. Therefore, setting the peripheral velocity of the development sleeve 3K slightly higher in the black monochromatic mode than in the full-color mode increases the operational cost, because it increases the electric power consumption of the image forming apparatus, and also, increases the amount of developer deterioration. Further, it shortens the life of the developing device 1K, and also, requires the maintenance interval to be decreased. Therefore, it is not desirable.

Incidentally, toners other than black toner, that is, the toners used by the image forming portions 100Y, 100M, and 100C, are higher in electrical resistance than black toner, being therefore less likely to be reversed in polarity than black toner, even when the peak-to-peak voltage Vpp is slightly higher than that applied in the black monochromatic mode. Thus, from the standpoint of minimizing the developer deterioration, the peripheral velocity of the development sleeve 3K was kept at the relatively smaller value, that is, 130 mm/sec, and the peak-to-peak voltage Vpp was set to 1.6 kV.

As described above, the image forming portion 100K of the image forming apparatus 100 has the developing device 1K, and primary transfer roller 23K. The developing device 1K develops an electrostatic latent image formed on the photosensitive drum 28K, into a toner image by applying development voltage, which includes AC component, to the development sleeve 3K on which charged toner is borne. The primary transfer roller 23K electrostatically transfers the black toner image formed on the photosensitive drum 28, onto the intermediary transfer belt 24, which is being moved, after the yellow toner image developed by the developing device 1Y is transferred onto the intermediary transfer belt 24. Further, the image forming apparatus 100 is designed so that when it is in the black monochromatic mode, in which only the developing device 1K among the four developing devices 1 it has is used, its developing device 1K is differently operated from when the image forming apparatus 100 is in the full-color mode, in which all four developing devices 1 are used. Further, the developing device 1K is designed so that when in the first mode, the peak-to-peak voltage Vpp of its development voltage can be reduced in amplitude compared to when in the second mode.

The toner used by the developing device 1K is black toner made up of carbon-based pigment. The development sleeve 3K of the developing device 1K bears black toner on its peripheral surface, which holds a minute gap from the peripheral surface of the photosensitive drum 28. In the first embodiment, when in the full-color mode, the peripheral velocity of the development sleeve 3K relative to the peripheral surface of the photosensitive drum 28 is set to be higher than when in the black monochromatic mode.

The image forming apparatus 100 is provided with multiple image forming portions 100Y, 100M, 100C, and 100K, which are arranged in tandem along the circular path of the intermediary transfer belt 24. Each image forming portion has the photosensitive drum 28, developing device 1, and primary transfer roller 23. The image forming portion 100K, which the most downstream image forming portion, forms the above-mentioned black toner image of the black toner. The first mode is the full-color mode in which multiple toner images are transferred from the multiple image forming portions 100Y, 100M, 100C, and 100K, one for one, onto the intermediary transfer belt 24. The second mode is the black monochromatic mode in which only the image forming portion 100K, that is, the most downstream image forming portion, forms a toner image, and transfers the toner image onto the intermediary transfer belt 24.

In the first embodiment, the phenomenon that the black reversed potential fog attributable to the reversely charged black toner particles is transferred onto the toner images different in color from the black toner image, and remains adhered thereto, is prevented by the addition of a simple control which uses the pre-existing setup of the image forming apparatus 100, that is, without providing the image forming apparatus 100 with an apparatus dedicated to the recovery of the reversed potential fog, or the like apparatus. Therefore, a high quality image, more specifically, an image which is pure in color and high in brightness, can be obtained without problematic side effects.

Incidentally, the above-mentioned values to which the peak-to-peak voltage Vpp and the peripheral velocity of the development sleeve 3K are set in the full-color mode and black monochromatic mode in the first embodiment are nothing but examples. That is, the peak-to-peak voltage Vpp and the peripheral velocity of the development sleeve 3K do not need to be limited to those mentioned above. All that is necessary to be done is that when the image forming apparatus 100 is in the full-color mode, the peak-to-peak voltage Vpp for the black developing device 1K is set to a value slightly smaller than that to which it is set when the image forming apparatus 100 is in the black monochromatic mode, in order to prevent the formation of the reversed potential fog attributable to the reversely charged toner particles, and also, that when the image forming apparatus 100 is in the full-color mode, the peripheral velocity of the development sleeve 3K is increased relative to the peripheral velocity of the development sleeve 3K when in the black monochromatic mode, in order to compensate for the reduction in the developmental efficiency, which is caused by the slight reduction in the peak-to-peak voltage Vpp. The effect of the second embodiment is the same as that of the first embodiment.

It is preferred that when in the full-color mode, the peak-to-peak voltage Vpp for the black developing device 1K is set lower roughly by 20-40%, and the peripheral velocity of the development sleeve 3K is set higher roughly by 20-40%, than when in the black monochromatic mode. With the peak-to-peak voltage Vpp for the black developing device 1K and the peripheral velocity of the development sleeve 3K set as described above, the formation of the reversed potential fog attributable to the reversely charged toner particles can be prevented without reducing the developmental efficiency of the developing device 1K in the full-color mode, and also, without causing the problem that developer in the developing device 1K is deteriorated faster than those in the other developing devices 1, and that the developing device 1K is shortened in life compared to the other developing devices 1.

As described above, according to the first embodiment, the problem that when the image forming apparatus 100 is in the full-color mode, the versed potential black fog is transferred onto the toner images of the other colors, can be prevented. Therefore, the problem that the reversely charged black toner particles causes the image forming apparatus 100 to yield an image deviant in tone from an intended image (original), by mixing into the wrong areas of the monochromatic toner images of the other colors is prevented. Therefore, the first embodiment makes it possible to provide a full-color image which is capable of printing an image which is highly precise and high in quality.

Incidentally, the first embodiment, was described with reference to the image forming apparatus 100 which employed the intermediary transfer belt 24 and multiple image forming portions arranged in tandem, and in which its black image forming portion 100K was located most downstream among the multiple image forming portions, as shown in FIG. 1. However the application of the first embodiment is not limited to an image forming apparatus which is the same in structure as the image forming apparatus 100. For example, the first embodiment is applicable to any full-color image forming apparatus operable in the black monochromatic mode as well as the full-color mode, as long as the image forming apparatus is structured so that when a black toner image is transferred in the full-color mode, toner images of the other colors are on the intermediary transfer belt or recording medium. The effects of the application the first embodiment to such a full-color image forming apparatus are the same as that obtained in this embodiment.

Further, the first embodiment was described with reference to the developing device which used two-component developer, the main ingredients of which are nonmagnetic toner and magnetic carrier. However, the first embodiment is also applicable to a developing device which uses single-component developer (toner), the main ingredient of which is nonmagnetic or magnetic toner. The effects of such an application are the same as those obtained by the developing device in this embodiment.

Embodiment 2

Figure 12:
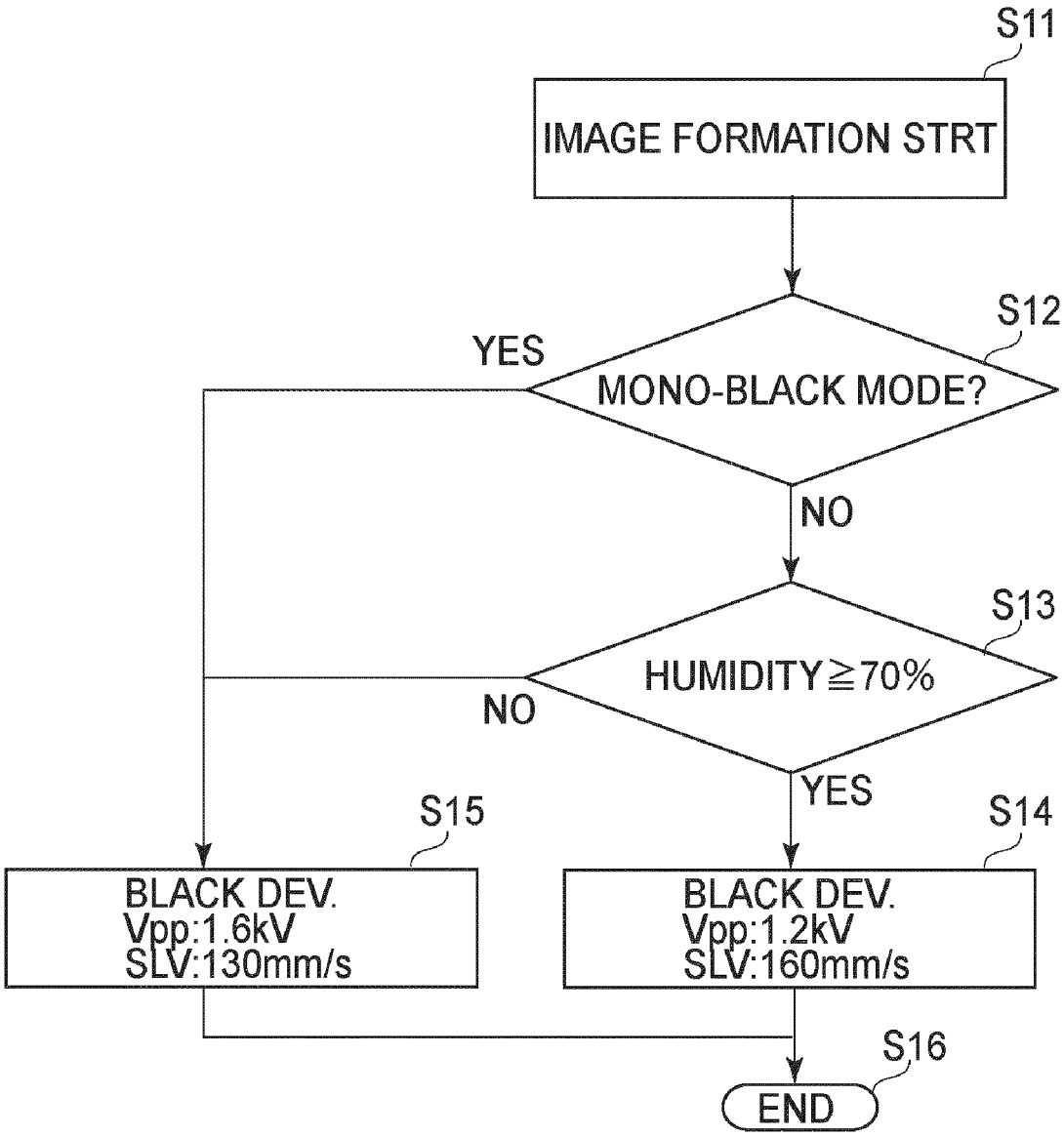
FIG. 12 is a flowchart of the control sequence in the second embodiment.

FIG. 12 is a flowchart of the control sequence in the second embodiment of the present invention. The structure of the image forming apparatus in the second embodiment is the same the structure of the image forming apparatus 100 in the first embodiment, which was described with reference to FIGS. 1-11. The second embodiment is only slightly different in the apparatus control from the first embodiment. In the second embodiment, whether or not the above-described setting (Table 1) in the first embodiment is used in the full-color mode and black monochromatic mode is determined based on the information regarding the humidity of the environment in which the image forming apparatus is operated.

As mentioned in the description of the first embodiment, the phenomenon that a reversed potential fog is created by black toner is sometimes caused by the injection of positive electric charge into black toner particles, which occurs while the black toner borne on the development sleeve 3K is moved through the development area. How easily positive electric charge is injected into black toner particles is dependent upon the electrical resistance of the black toner (developer).

However, the electrical resistance of developer is substantially affected by the absolute humidity of the environment in which an image forming apparatus is operated. That is, as the environment in which an image forming apparatus is operated increases in humidity, the developer in the apparatus absorbs moisture, and therefore, reduces in electrical resistance. Thus, the problem that a foggy image attributable to the reversely charged toner particles is formed occurs only when the humidity of the environment in which an image forming operation is operated is higher than a certain value. In other words, in practical terms, this problem is not going to occur when the humidity of the environment in which an image forming apparatus is operated is less than a certain value.

Therefore, in the second embodiment, a humidity sensor 9 (humidity detecting means) is placed in the adjacencies of the development sleeve 3 of the developing device 1 of the main assembly of the image forming apparatus. The controller 35 determines the absolute humidity of the environment in which the image forming apparatus is operated, from the output of the humidity sensor 9, and controls the image forming portion 100K, as it does in the first embodiment, only when the image forming apparatus is in the full-color mode and the absolute humidity is higher than a preset referential value.

Referring to FIG. 12, as an image forming operation is started (S11), the controller 35 determines whether the image forming apparatus is in the black monochromatic mode or full-color mode (S12). If it determines that the image forming apparatus is in the black monochromatic mode (Yes in S12), it unconditionally sets the peak-to-peak voltage Vpps of the developing devices 1 and the peripheral velocities of the development sleeves 3 to the values for the black monochromatic mode given in Table 1 (S15). If the controller 35 determines that the image forming apparatus is in the full-color mode (No in S12), it determines the absolute humidity based on the output of the humidity sensor 9, and then, determines whether the detected absolute humidity is no less than the referential value, which in this embodiment is 70% (S13).

If the controller 35 determines that the absolute humidity is no less than 70% (Yes in S13), it employs the setting for the full-color mode given in Table 1, as in the first embodiment (S14). If it determines that the absolute humidity is less than 70% (No in S13), it employs the setting for the monochromatic mode given in Table 1 (S15).

In the second embodiment, the image forming apparatus has the humidity sensor 9, which is the means for detecting the index (amount) of the humidity which reduces the electrical resistance of toner. When the humidity is no more than a preset value, which in this embodiment is 70%, the value to which the peak-to-peak voltage Vpp is set in the full-color mode is the same as the value to which the peak-to-peak voltage Vpp is set in the black monochromatic mode.

Also in the second embodiment, only when the absolute humidity is no less than the preset referential value of 70%, that is, when the reversed potential fog attributable to the reversely charged toner particles is likely to be formed because of humidity, and the image forming apparatus is in the full-color mode, the image forming portion 100K is controlled in the same manner as it is in the first embodiment. When the humidity is less than the referential value, the peak-to-peak voltage Vpp of the black developing device 1K and the peripheral velocity of the development sleeve 3K are set to the same values as those for the black monochromatic mode in the first embodiment. With the addition of this control, which is executed based on the humidity, the same effects as those obtained in the first embodiment can be obtained. Further, when the image forming apparatus is operated in an environment in which a reversed potential fog attributable to the reversely charged toner particles is not going to be formed, in practical terms, it is unnecessary to increase the development sleeve 3K in peripheral velocity. Therefore, the developer is prevented from being unnecessarily deteriorated.

The above-described control in the first or second embodiment can be used even by an image forming apparatus such as the one disclosed in Japanese Laid-open Patent Application 2003-255663. With the employment of the above-described control, the image forming apparatus can accomplish both the object of preventing the formation of a reversed potential black fog attributable to the reversely charged black toner particles, in the full-color mode, and the object of reducing the peripheral velocity of the development sleeve of the black developing device, in the black monochromatic mode.

The image forming apparatus in the second embodiment has a single photosensitive drum, a rotary developing device, and a stationary developing device. The rotary developing device is made up of a rotary, and three developing devices, that is, yellow, magenta, and cyan developing devices, which use two-component developer. The stationary developing device is the black developing device, which uses magnetic single-component developer. The rotary is positioned so that the development roller of the yellow, magenta, or cyan developing device can be placed virtually in contact with the peripheral surface of the photosensitive drum, whereas the stationary developing device, that is, the black developing device is positioned so that its development roller is placed virtually in contact with the peripheral surface of the photosensitive drum. In its image forming operation, yellow, magenta, cyan, and black toner images are sequentially formed on the same photosensitive drum (single photosensitive drum) by switching the developing devices. Then, they are sequentially transferred in layers (primary transfer) onto the intermediary transfer drum, and then, are transferred together (secondary transfer) from the intermediary transfer drum onto the recording medium.

Embodiment 3

The above-described control in the first or second embodiment can be used even by an image forming apparatus such as the one disclosed in Japanese Laid-open Patent Application 2001-188394 as long as the apparatus is enabled to operate in the black monochromatic mode as well as full-color mode. With the employment of the above-described control, the image forming apparatus can accomplish both the object of preventing the formation of a reversed potential black fog attributable to the reversely charged black toner particles, in the full-color mode, and the object of reducing the peripheral velocity of the development sleeve of the black developing device, in the black monochromatic mode.

The image forming apparatus in the third embodiment has a recording medium conveying belt, and multiple image forming portions, that is, yellow, magenta, cyan, and black image forming portions, which are arranged in tandem, next to the top portion (straight portion) of the loop which the recording medium conveying member forms. In its image forming operation, four monochromatic toner images, different in color, formed in the four image forming portions, one for one, are directly transferred in layers onto the recording medium which is being conveyed by the recording medium conveying belt while remaining adhered to the belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 033598/2007 filed Feb. 14, 2007, which is hereby incorporated by reference.

What is claimed is:

1. An image forming apparatus comprising:

a first developing device including a first developer carrying member for carrying a developer containing toner, wherein a developing voltage including an AC component is applicable to said first developer carrying member to develop an electrostatic image;

a second developing device including a second developer carrying member for carrying a developer containing toner, wherein a developing voltage including an AC component is applicable to said second developer carrying member to develop an electrostatic image;

a transferring device for transferring a toner image formed by said first developing device to a moving transfer medium and then transferring a toner image formed by said second developing device onto the transfer medium;

a controller for selectively executing an operation in a first mode wherein the image is formed by both of said first developing device and said second developing device or in a second mode wherein the image is formed by only said second developing device of said developing devices; and a bias controller for controlling an AC bias applied to said second developing device such that an amplitude of the AC bias applied to said second developing device in the first mode is smaller than the amplitude in the second mode.

2. An apparatus according to claim 1, wherein said second developer carrying member is rotatable, and said second developer carrying member of said second developing device is rotatable at a higher speed in the first mode than in the second mode in a developing operation.

3. An apparatus according to claim 1, further comprising detecting means for detecting a humidity of an ambient condition in which a main assembly of the apparatus is placed, wherein when the humidity indicated by an output of said detecting means is lower than a predetermined level, said bias controller sets the amplitudes in the first mode and the second mode at the same level in said second developing device, and wherein when the humidity indicated by the output of said detecting means is not lower than the predetermined level, the amplitude in the first mode is set smaller than the amplitude in the second mode in said second developing device.

4. An apparatus according to claim 1, wherein the toner in said second developing device is black toner containing carbon pigment.

5. An apparatus according to claim 4, wherein the toner in said first developing device is chromatic toner, and wherein the first mode is a color image forming mode, and said second mode is a monochromatic black image forming mode.

* * * * *